United States Patent [19]

Dischert

[11] 4,419,848

[45] Dec. 13, 1983

[54] METHOD AND APPARATUS FOR ROTATING A STYLUS DURING LAPPING

[75] Inventor: William A. Dischert, Jobstown, N.J.

[73] Assignee: RCA Corporation, New York, N.Y.

[21] Appl. No.: 297,054

[22] Filed: Aug. 27, 1981

[51] Int. Cl.[3] ..... B24B 9/16; B24B 1/00

[52] U.S. Cl. ..... 51/229; 51/125.5; 51/131.1; 51/283 R

[58] Field of Search ..... 51/125.5, 125, 229, 51/131.1, 121, 216 H, 64, 65, 283 R; 74/813 C; 415/202, 80; 92/121–125

[56] References Cited

U.S. PATENT DOCUMENTS 3,026,088 3/1962 Green ..... 415/80
3,193,251 7/1965 Brunel et al. ..... 415/202

FOREIGN PATENT DOCUMENTS 111092 6/1900 Fed. Rep. of Germany ..... 51/229
2026357 2/1980 United Kingdom ..... 51/125.5

*Primary Examiner*—Harold D. Whitehead
*Assistant Examiner*—Debra S. Meislin
*Attorney, Agent, or Firm*—Birgit E. Morris; Donald S. Cohen; Thomas H. Magee

[57] ABSTRACT

A stylus is attached to one end of a stylus holder which is mounted on a trunnion and adapted to rotate about a first axis. Attached to the trunnion is means for pivoting the trunnion about a second axis transverse to the first axis, in order to position the tip of the stylus adjacent a surface of a rotating scaife. A stream of fluid is directed against a vane attached to the stylus holder in a manner such that the fluid causes the holder to rotate about the trunnion, thereby changing the rotational position of the stylus without significantly altering the force of the stylus against the scaife.

12 Claims, 2 Drawing Figures

METHOD AND APPARATUS FOR ROTATING A STYLUS DURING LAPPING

This invention relates to a method and apparatus for rotating a stylus adjacent a rotating scaife while lapping a tip of the stylus.

BACKGROUND OF THE INVENTION

Information playback systems frequently utilize a stylus for reading signals from the surface of an information record, typically a plastic disc that contains stored video and audio information. In some systems the information record has a fine spiral groove to guide the tip of a stylus that contains a thin electrode. In these systems, the stylus tip is made of a material having sufficient hardness to withstand the abrasion caused from tracking the groove. Materials which possess such hardness, such as diamond, generally have a crystallographic structure which presents surfaces exhibiting different qualities depending upon which crystallographic plane the surfaces are oriented along. The video disc stylus utilized in the CED (capacitance electronic disc) system is tapered to form the prow of the tip, and is also lapped to form a keel having a V-shaped shoe for its bottom portion. This keel-shaped tip has a shoe length of about 3 to 5 micrometers and a thickness of about 2 micrometers. Making a long-shanked stylus entirely from the same material may become expensive, particularly when the tip material, for example diamond, exceeds the cost of other suitable materials from which the shank can be made.

In order to reduce manufacturing costs, a metallic-shanked diamond audio stylus may be utilized as a starting structure from which to manufacture the video disc stylus. A typical audio stylus has a length of about 2.5 millimeters. The shank of the audio stylus comprises a titanium rod having a diameter of about 300 micrometers, at the end of which is mounted a randomly-oriented natural diamond stone in the shape of a 50 degree cone. In fabricating the desired structure from the diamond tip of the audio stylus, a reference surface is cut along a chord of the cylindrically-shaped metallic shank about 50 micrometers in from the circumference, in order to ensure that the proper orientation is achieved during each of the fabricating processes. An electrode facet is lapped at an angle of about 30 degrees from the longitudinal axis, and an electrode metal is deposited thereon. After the electrode material is formed, the tip is again lapped with a rotating scaife to form a pair of side or prow facets which are substantially symmetrical. When lapping these two side surfaces, the stylus is rotated between two different positions in order to alternately lap each of the side surfaces. The present invention provides a novel technique for changing the rotational position of the stylus without significantly altering the force of the stylus against the lapping scaife.

SUMMARY OF THE INVENTION

The present invention comprises a method and apparatus for rotating a stylus while a tip of the stylus is positioned adjacent a rotating scaife. The stylus is attached to one end of a stylus holder which is mounted on a trunnion and adapted to rotate about a first axis. Attached to the trunnion is means for pivoting the trunnion about a second axis transverse to the first axis, in order to position the tip of the stylus adjacent a surface of a rotating scaife. A stream of fluid is directed against a vane attached to the stylus holder in a manner such that the fluid causes the holder to rotate about the trunnion, thereby changing the rotational position of the stylus without significantly altering the force of the stylus against the scaife.

DETAILED DESCRIPTION OF THE PREFERRED EMBODIMENT

Figure 1:
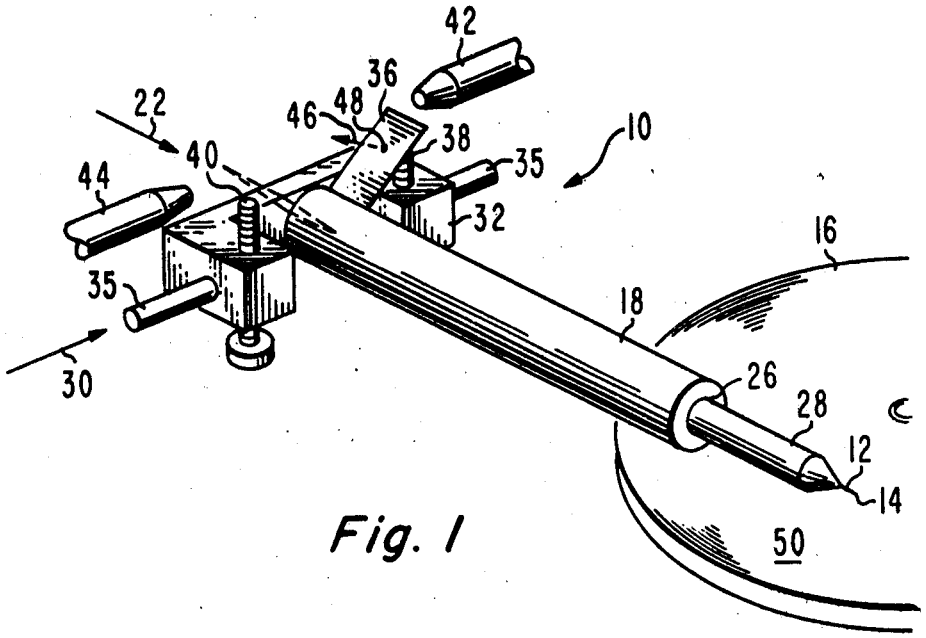
FIG. 1 is a perspective view illustrating one embodiment of the present novel apparatus.
Figure 2:
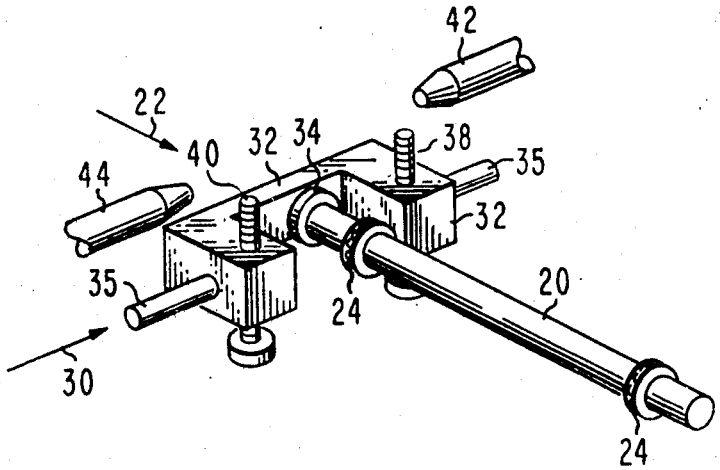
FIG. 2 is a perspective view illustrating the apparatus shown in FIG. 1 with the stylus holder removed therefrom.

In FIG. 1 of the drawing, there is shown one embodiment of an apparatus 10 for rotating a stylus 12 while a tip 14 thereof is positioned adjacent a rotating scaife 16. The apparatus 10 comprises a stylus holder 18 mounted on a trunnion 20 (shown in FIG. 2) and adapted to rotate about a first axis 22 oriented along the longitudinal axis of the trunnion 20. In the present embodiment, the trunnion 20 comprises a cylindrical shaft, as illustrated in FIG. 2, and the stylus holder 18 comprises a cylindrical tube mounted over the shaft on ball bearings 24 affixed thereto. The stylus holder 18 has one end 26 thereof adapted to receive the stylus 12 and hold it in a fixed position relative thereto during lapping. In the present embodiment, the stylus 12 is actually held by a fixture 28, which is then attached to the one end 26 of the stylus holder 18, as shown in FIG. 1.

Attached to the trunnion 20 is means for pivoting the trunnion 20 about a second axis 30 transverse to the first axis 22. The pivoting means may comprise a U-shaped yoke 32 having its middle inside portion attached to one end 34 of the shaft or trunnion 20, as shown in FIG. 2. Each end of the yoke 32 is connected to an axle 35 designed to pivot the yoke about the second axis 30. The axles 35 are held in supports (not shown) in which they are free to rotate about the second axis 30.

The novel apparatus 10 further comprises a vane 36 attached to the stylus holder 18 in a manner such that a fluid directed against the vane 36 causes the holder 18 to rotate about the trunnion 20. Although the vane 36 in FIGS. 1 and 2 is illustrated as a thin flat sheet, the use of the word "vane" in the present invention is meant to encompass any area or surface, including a curved surface, which is capable of receiving a fluid directed thereagainst and, in response thereto, causing the stylus holder 18 to rotate about the first axis 22. In other embodiments (not shown), the stylus holder 18 may have a series of vanes attached thereto, e.g., a quasi turbine wheel, so that the holder 18 may be effectively rotated through a greater arc about the first axis 22. Preferably, the apparatus 10 also includes a first and a second stop 38 and 40 positioned, respectively, on opposite sides of the vane 36 in order to contact either the vane 36, as shown in FIG. 1, or the stylus holder 18 and thereby prevent further rotation of the holder 18 about the first axis 22. The first and second stops 38 and 40 may simply comprise adjustable screws connected to the pivoting means, i.e., at both ends of the U-shaped yoke 32.

The apparatus 10 also comprises means for directing a stream of fluid against the vane 36. In the present embodiment, the directing means comprises a first and a second air nozzle 42 and 44 positioned, respectively, on opposite sides of the vane 36 such that the first and the second nozzles 42 and 44 direct streams of air oriented along a direction parallel to the second axis 30 and aimed to strike, respectively, opposite sides of the vane 36. The fluid stream of air produces a resultant force vector 46 acting upon the vane 36 at an application point 48 thereof. Preferably, the vane 36 and the directing means, i.e., the first and second air nozzles 42 and 44, are positioned such that this resultant force vector 46 lies along a plane containing the second axis 30.

In the present embodiment, in order to have the resultant force vector 46 lie along a plane containing the second axis 30, the vane 36 is geometrically shaped and attached to the stylus holder 18 such that it is substantially bisected by the plane containing the second axis 30 and orthogonal to the first axis 22. As shown in FIG. 1, the vane 36 may comprise simply a flat rectangular-shaped sheet which is affixed to the stylus holder 18 so that it extends radially from the surface of the holder 18, and thus serves as a finlike turbine blade.

The present method of rotating the stylus 12 while lapping the tip 14 comprises the first step of attaching the stylus 12 to the one end 26 of the stylus holder 18. The trunnion 20 is then pivoted about the second axis 30 in order to position the tip 14 of the stylus 12 adjacent the surface 50 of the rotating scaife 16.

A stream of fluid is directed against the vane 36 in a manner such that the fluid causes the stylus holder 18 to rotate about the trunnion 20. In the present embodiment, a stream of air is directed from the first air nozzle 42 against one side of the vane 36, so that the stylus holder 18 is rotated to a first position whereat the vane 36 is held firmly against the first stop 38. The tip 14 of the stylus 12 is then lapped in this first position for a period of time.

After a facet is cut in the tip 14, while being held in this initial position, the air from the first air nozzle 42 is turned off and a stream of air from the second air nozzle 44 is directed against the opposite side of the vane 36. This causes the stylus holder 18 to rotate to a second position, whereat the vane 36 is held firmly against the second stop 40. The air continues to hold the stylus holder 18 firmly against the second stop 40 without imparting any change in lapping force. If a cone is being formed, the air may be directed against a series of vanes, e.g., a turbine wheel, in order to rotate the stylus holder without imparting any change in lapping force.

The essence of the present invention is that the novel apparatus 10 enables the rotational position of the stylus 12 to be changed without altering the force of the stylus 12 against the lapping scaife 16. By utilizing the combination of the vane 36 with the fluid stream to generate the rotating force, the stylus holder 12 is free to move toward or away from the surface 50 of the lapping scaife 16 by providing the trunnion 20 with the freedom to rotate about the second axis 30. Normally, the force of the stylus 12 against the scaife 16 is determined by the weight of both the U-shaped yoke 32 and the stylus holder 18 as the stylus 12 rides on the surface 50 of the scaife 16. In order to rotate the stylus 12 without altering this lapping force, it is necessary that the rotation be performed without generating any additional torque about the second axis 30. By positioning the vane 36 and the air nozzles 42 and 44 such that the rotating force vector 46 lies along a plane containing the second axis 30, there can be no additional torque moment causing rotation about the second axis 30, which would alter the lapping force. Applicant's present embodiment controls the placement of the resultant force vector 46 by positioning the vane 36 so that it is substantially bisected by the plane containing the second axis 30 and orthogonal to the first axis 22. If means other than a fluid was utilized to contact the vane 36, the friction between the vane 36 and the contacting structure would provide an additional torque moment which would alter the force of the stylus 12 against the scaife 16. The use of a fluid stream minimizes any such friction which would restrict the free movement about the second axis 30, and thereby avoid any such resisting torque. The fluid also enables the stylus holder 18 to be held firmly against the stops 38 and 40 without imparting any change in lapping force.

What is claimed is:

1. An apparatus for rotating a stylus while a tip thereof is positioned adjacent a rotating scaife comprising:

a stylus holder mounted on a trunnion and adapted to rotate about a first axis, means attached to said trunnion for pivoting said trunnion about a second axis transverse to said first axis, a vane attached to said holder and positioned adjacent said second axis in a manner such that a fluid directed against said vane causes said holder to rotate about said trunnion, and means for directing a stream of fluid against said vane said position of said vane and said directing means being such that the rotation of said holder is effected without generating a significant additional torque movement about said second axis.

2. An apparatus as defined in claim 1 wherein said fluid stream produces a resultant force vector acting upon said vane at an application point thereof, and wherein said vane and said directing means are positioned such that said force vector lies along a plane containing said second axis.

3. An apparatus as defined in claim 1 wherein said vane is substantially bisected by the plane containing said second axis and orthogonal to said first axis.

4. An apparatus as defined in claim 1 further comprising a first and a second stop positioned, respectively, on opposite sides of said vane in order to contact said vane and thereby prevent further rotation of said holder about said first axis.

5. An apparatus as defined in claim 4 wherein said stops comprise adjustable screws connected to said pivoting means.

6. An apparatus as defined in claim 1 wherein said trunnion comprises a cylindrical shaft, and wherein said stylus holder comprises a cylindrical tube mounted over said shaft on bearings, said holder having one end thereof adapted to receive said stylus.

7. An apparatus as defined in claim 6 wherein said pivoting means comprises a U-shaped yoke attached to one end of said shaft, each end of said yoke being connected to an axle designed to pivot said yoke about said second axis.

8. An apparatus as defined in claim 1 wherein said directing means comprises a first and a second air nozzle positioned, respectively, on opposite sides of said vane such that said first and said second nozzles direct streams of air oriented along a direction parallel to said second axis and aimed to strike, respectively, opposite sides of said vane.

9. A method of rotating a stylus while lapping a tip thereof comprising the steps of:

attaching said stylus to one end of a stylus holder, said holder mounted on a trunnion and adapted to rotate about a first axis, pivoting said trunnion about a second axis transverse to said first axis, in order to position the tip of said stylus adjacent a surface of a rotating scaife, and directing a stream of fluid against a vane positioned adjacent said second axis and attached to said stylus holder in a manner such that said fluid causes said holder to rotate about said trunnion without generating a significant additional torque movement about said second axis.

10. A method as recited in claim 9 wherein said fluid stream produces a resultant force vector acting upon said vane at an application point thereof, and wherein said vane and said directing means are positioned such that said force vector lies along a plane containing said second axis.

11. A method as recited in claim 9 wherein said vane is substantially bisected by the plane containing said second axis and orthogonal to said first axis.

12. A method as recited in claim 9 further comprising the step of positioning a first and a second stop, respectively, on opposite sides of said vane in order to contact said vane and thereby prevent further rotation of said holder about said first axis, and wherein said directiong step is performed firstly by directing a stream of air from a first air nozzle positioned on one side of said vane, whereby said stylus holder is rotated to a first position whereat said vane is held firmly against said first stop, and secondly by directing a stream of air from a second air nozzle positioned on the side opposite the one side of said vane, whereby said stylus holder is rotated to a second position whereat said vane is held firmly against said second stop.

* * * * *